US005779519A

United States Patent [19]

Oliver

[11] Patent Number: 5,779,519

[45] Date of Patent: Jul. 14, 1998

[54] SCENTED FINGERNAIL FILES AND BUFFERS

[75] Inventor: G. Brian Oliver, Newport Coast, Calif.

[73] Assignee: SunFiles, LLC, Del Mar, Calif.

[21] Appl. No.: 746,796

[22] Filed: Nov. 18, 1996

[51] Int. Cl.[6] ..... B24B 7/19

[52] U.S. Cl. ..... 451/28; 451/59; 451/530; 451/533; 451/539; 428/905; 428/321.5; 428/323

[58] Field of Search ..... 451/28, 59, 526, 451/527, 530, 533, 538, 539; 428/905, 323, 321.5

[56] References Cited

U.S. PATENT DOCUMENTS 4,687,203 8/1987 Spector ..... 273/157 R
5,658,184 8/1997 Hoopman et al. ..... 451/539

*Primary Examiner*—Eileen P. Morgan
*Attorney, Agent, or Firm*—Richard L. Myers

[57] ABSTRACT

A scented fingernail file and buffer for contacting and filing a target surface includes a base structure and a substrate layer disposed on the base structure. The scented fingernail file and buffer further includes an abrasive material and fragrance capsules. Both the abrasive material and the fragrance-filled capsules are disposed within the substrate layer. This substrate layer may comprise two coats of resin, for example. The abrasive material includes abrasive particles, and the fragrance-filled capsules are adapted for being ruptured by the abrasive particles, when the scented fingernail file and buffer is frictionally placed into contact with the target surface. The fragrance-filled capsules may also be ruptured by the target surface, or a combination of both the abrasive particles and the target surface, upon such contact.

20 Claims, 1 Drawing Sheet

FIG. 1
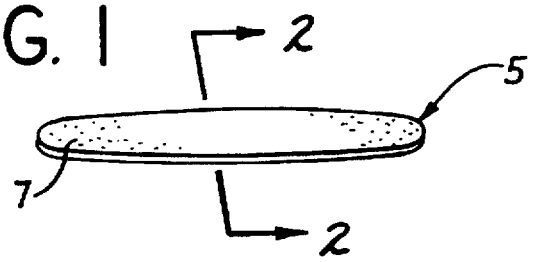
FIG. 3
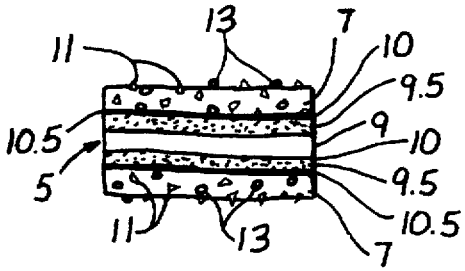
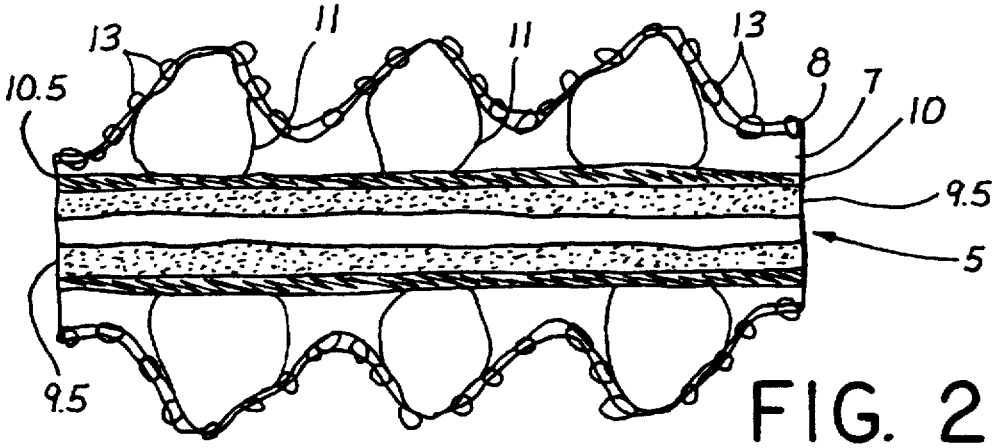
FIG. 2
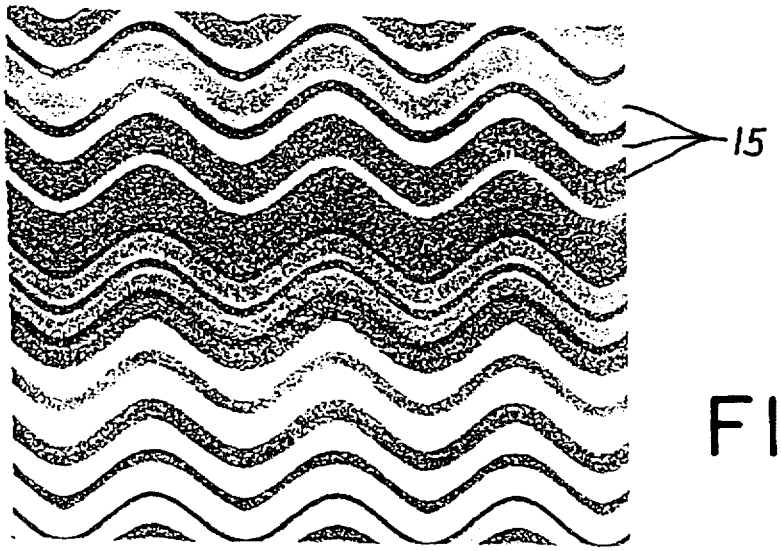
FIG. 4

SCENTED FINGERNAIL FILES AND BUFFERS

BACKGROUND OF THE INVENTION

1. Field of the Invention

The present invention relates generally to fingernail files and buffers and, more particularly, to colored and scented fingernail files and buffers.

2. Description of Related Art

Conventional fingernail files and buffers typically comprise a base structure and an abrasive surface disposed thereon. The base structure may comprise a strip of wood, metal or plastic. The abrasive surface usually comprises a fine-grained impure corundum, or silicon carbide, or aluminum oxide, or diamond or glass/quartz, which is suitable for grinding and polishing. A powdered glass, for example, can be applied to the base structure, using an adhesive, to form the abrasive surface.

A fingernail file and buffer can be used to file or polish a fingernail or toenail, as is well known in the art. The fingernail file and buffer is frictionally moved along the surface of the fingernail or toenail in order to shape and smooth or polish the fingernail or toenail, to thereby eliminate splits, snags and chipping, or achieve a high gloss finish. Fingernail files and buffers typically comprise brown, tan, or black abrasive surfaces. These dull colors are not particularly attractive.

Prior art fingernail files and buffers heretofore have never been manufactured with any bright or uplifting colors and, additionally, have not been made with any pleasant aromas or fragrances associated therewith.

Fragrances, which can be activated by frictional contact, have been implemented by the prior art in various devices. U.S. Pat. No. 5,355,551 issued to Schechter et al. discloses a curtain ring having an inner surface coated with a fragrance-emitting material. The fragrance-emitting material can comprise microspheres containing fragrance chemicals, or materials used in "scratch-and-sniff" products. U.S. Pat. No. 3,570,139 issued to Ladd et al., discloses a "scratch-and-sniff" system, which is well known in the art. U.S. Pat. Nos. 4,813,976 and 4,764,362, both issued to Barchas, disclose emery boards having films of lubricant and conditioner disposed thereon. None of the prior art systems, however, have manufactured emery boards having fragrances disposed thereon.

The applicant is not aware of any abrasive structure, having either bright colors or fragrance-filled capsules disposed thereon. Nor is applicant aware of any prior art system having a substrate with both abrasive particles and fragrance-filled capsules formed within the substrate.

SUMMARY OF THE INVENTION

The brightly colored and scented fingernail files and buffers of the present invention are particularly appealing to a user's visual and olfactory senses. Users who do not particularly enjoy filing their nails, for example, may be encouraged to perform this grooming feature more frequently. The fragrances, which are emitted from the scented fingernail file and buffer upon frictional contact with the user's nail, can operate to condition and deodorize the air.

According to one aspect of the present invention, a scented fingernail file and buffer for contacting and filing a target surface includes a base structure and a substrate layer disposed on the base structure. The scented fingernail file and buffer further includes an abrasive material and fragrance capsules. Both the abrasive material and the fragrance-filled capsules are disposed within the substrate layer. This substrate layer may comprise two coats of resin, for example. The abrasive material includes aluminmum oxide, or silicon-carbide, or diamond, or glass/quartz particles, and the fragrance-filled capsules are adapted for being ruptured by the abrasive particles, when the scented fingernail file and buffer is frictionally placed into contact with the target surface. The fragrance-filled capsules may also be ruptured by the target surface, or a combination of both the abrasive particles and the target surface, upon such contact.

The scented fingernail file and buffer further includes brightly colored pigments disposed on the surface of the fingernail file and buffer. These brightly colored pigments may be selected to conjure light, bright, or fruit-colored associations with the user. Additionally, the fragrances emitted by the fragrance-filled capsules are manufactured to include fruit aromas. The scented fingernail file and buffer may include a nail file, the base structure may include a strip of plastic, and the substrate may include an adhesive, such as a resin. The adhesive operates to attach both the abrasive particles and the fragrance-filled capsules onto the base structure. The substrate layer and the base may be integrally formed of the same materials, according to one aspect of the present invention.

According to a method of the present invention, a scented nail file having a plurality of abrasive particles and fragranced particles disposed therein, is placed into frictional contact with a target surface. The scented nail file is moved over the target surface, which may include the nail of a user, for example. Movement of the scented nail file over the target surface causes the abrasive particles to file the target surface and, simultaneously, causes the fragranced particles to emit fragrances onto the target surface and into the atmosphere.

The present invention, together with additional features and advantages thereof, may best be understood by reference to the following description taken in connection with the accompanying illustrative drawings.

BRIEF DESCRIPTION OF THE DRAWINGS

FIG. 1 illustrates a top planar view of a scented fingernail file and buffer, according to the present invention;

FIG. 2 illustrates a cross-sectional view of the scented fingernail file and buffer, taken along line 2—2 of FIG. 1 according to the presently preferred embodiment;

FIG. 3 illustrate cross-sectional view of the scented fingernail file and buffer, taken along line 2—2 of FIG. 1 according to an alternative embodiment; and FIG. 4 illustrates a wavy pattern, formed of various color pigments, and formed on a surface of the scented fingernail file and buffer, according to the presently preferred embodiment.

DETAILED DESCRIPTION OF THE PRESENTLY PREFERRED EMBODIMENTS

Turning to FIG. 1, a scented fingernail file and buffer 5 is illustrated, according to the presently preferred embodiment. The scented fingernail file and buffer 5 comprises a substrate layer 7 having abrasive particles disposed thereon.

FIG. 2 illustrates a cross-sectional view of the scented fingernail file and buffer 5 of the presently preferred embodiment, taken along line 2—2 of FIG. 1. The scented fingernail file and buffer 5 comprises a base structure 9 and/or 9.5, and at least one substrate layer 7. The base structure 9 may be sandwiched between two layers of foam or similar cushion materials 9.5 and two substrate layers 7, as shown in FIG. 3, for example, or one or more substrate layers 7 may be disposed on only a single side of the base structure 9 and/or 9.5. According to an alternative embodiment, the substrate layer 7 and base structure 9 and/or 9.5 may be integrally formed of the same material.

The embodiment of FIG. 2, which comprises a first substrate layer 7 and a second substrate layer 8, is presently preferred. The first substrate layer 7 comprises abrasive particles 11, and the second substrate layer 8 comprises a fragrance-emitting means 13 disposed therein. The abrasive particles 11 may comprise garnet, flint, and/or abrasive particles, aluminum oxide, silicon carbide, diamond and/or glass/quartz. The fragrance-emitting means 13 may comprise any material that releases fragrance into the surrounding atmosphere when rubbed against an appropriate surface. For example, certain waxes that have been impregnated with fragrance are known to release fragrances into the atmosphere, upon frictional rubbing of the wax. Additionally, materials used in conventional "scratch-and-sniff" products may be used. As presently preferred, the fragrance-emitting means 13 comprises fragrance-filled capsules containing fragrance chemicals. These fragrances may be generated or obtained from a variety of sources. The fragrances are preferably encased in gelatin capsules. The fragrance-filled capsules of the presently preferred embodiment are manufactured by LIPO Technologies Inc., which is headquartered in Peterson, N.J.

In the presently preferred embodiment, both the abrasive particles 11 and the fragrance-filled capsules 13 are suspended within corresponding substrate layers 7 and 8, respectively. As presently embodied, the base 10 may comprise a paper, film, or cloth, or any combination thereof. The base structure 9 may comprise wood, plastic or metal. A make coat 10.5, which may comprise phenol, urethane, epoxy resin, or any combination thereof, is preferably applied over the base 10. Next, a size coat 10.5, comprising materials similar to the make coat, is applied over the make coat. As can be seen from FIG. 2, the abrasive particles 11 are suspended within the first substrate layer 7. According to the presently preferred embodiment, the size of the abrasive particles is in a range of 30 microns to 70 microns. For slightly finer and rougher surfaces, abrasive particle sizes may be brought down to a 1 (one) micron diameter or up to a 90 micron diameter, respectively. Additionally, other sizes of abrasive particles 11 may be implemented, according to design parameters.

The fragrance-filled capsules 13 may be applied over both the first substrate layer 7 and the abrasive particles 11 in several ways. As presently preferred, the fragrance-filled capsules 13 comprise diameters in a range of 10 to 40 microns, but other sized fragrance-filled capsules 13 may also be used. Regardless of the technique used for applying the fragrance-filled capsules 13, the relatively small sizes of the fragrance-filled capsules 13 will result in the fragrance-filled capsules 13 being disposed over both the abrasive particles 11 and the first substrate layer 7. As can be seen from FIG. 2, for example, a number of the fragrance-filled particles 13 are disposed on top of the abrasive particles 11, and a number of the fragrance-filled capsules are disposed in valleys between the abrasive particles 11, to thereby provide a long-lasting effect. According to this embodiment, as the abrasive particles 11 ware, fragrance-filled capsules 13 in the valleys between the abrasive particles 11 will become active.

In a first application method, the fragrance-filled capsules 13 are mixed in a resin, which forms the second substrate layer 8. The fragrance-filled capsules 13 and the second substrate layer 8 are then applied over the first substrate layer 7 and the abrasive particles 11. The fragrance-filled capsules 13 may, alternatively, be mixed in an aqueous or liquid mineral spirit base and either sprayed or wiped over the first substrate layer 7 and the abrasive particles 11. The aqueous or liquid mineral spirit base then evaporates, exposing the frgrance-filloed capsules 13. Other application techniques may also be used, as long as the fragrance-filled capsules 13 are secured to the first substrate layer 7 and the abrasive particles 11.

In one alternative embodiment, the abrasive particles 11 and the fragrance-filled capsules 13 may be mixed together in a resin and then applied to the base 9, as illustrated in FIG. 3. FIG. 3 illustrates an alternative embodiment where the abrasive particles 11 and the fragrance-filled capsules 13 have approximately equal diameters. According to the embodiment illustrated in FIG. 3, abrasive particles 11 and fragrance-filled capsules 13 are disposed on both sides of the base structure 9, but they nay alternatively be disposed only on a single side of the base structure 9.

FIG. 4 illustrates the presently preferred pattern of brightly colored pigments 15 that is preferably impregnated into the substrate layers 7, 10 and 10.5. The brightly colored pigments 15 may be applied to the substrate layer 7 at any stage during the manufacturing process. As presently preferred, the brightly colored pigments 15 are applied during the first steps of the manufacture of the scented fingernail file and buffer 5. The brightly colored pigments 15 preferably correspond to colors associated with fruits or plants, for example. In this presently preferred embodiment, the fragrance-filled capsules 13 are configured to emit scents having fruit-like aromas or garden and herbal scents such as roses. The scents may comrpise fruit, plant, herbal, other scents occuring in nature and/or man made materials.

A primary function of the fragrance-filled capsules 13 and the brightly colored pigments 15 is to increase the visual and olfactory pleasure of the user, upon use of the scented fingernail file and buffer 5. This augmentation of pleasure, associated with use of the scented fingernail file and buffer 5 of the present invention, can result in increased use of the scented fingernail file and buffer 5 by its users, and can also results in increased sales of the scented fingernail file and buffer 5. Increased use of the scented fingernail file and buffer 5 may be advantageous to users, who do not particularly enjoy filing their fingernails and/or toenails.

The abrasive particles 11 and the fragrance-filled capsules 13 of the presently preferred embodiment can be configured so that an attenuation in fragrances emitted from the scented fingernail file and buffer 5 upon use will indicate an attenuation in the abrasiveness of the substrate layer 7. A user may desire a consistently abrasive surface in order to predict the amount of filing required on the user's fingernails for consistent results. A user would obviously have to file greater amounts with a slightly abrasive fingernail file and buffer, than with an fingernail file and buffer having an almost-new abrasive surface thereon. A user desiring an fingernail file and buffer with a consistently abrasive surface will, according to this feature of the present invention, know when to replace the scented fingernail file and buffer 5, based upon the strength of the fragrance emitted from the scented fingernail file and buffer 5 during use. For instance, the user may choose to replace the scented fingernail file and buffer 5 when he or she can no longer detect a fragrance during use.

A unique feature of the present invention comprises the combination of fragrance-filled capsules 13 and abrasive particles 11. Since the abrasive particles 11 are basically in intimate contact with the fragrance-filled capsules 13, the fragrance-filled capsules 13 are more likely to be ruptured when the scented fingernail file and buffer 5 is used. Since the abrasive particles 11 are generally harder and more abrasive than conventional surfaces, such as fingernails, a fragrance-filled capsule 13 will be more likely to be ruptured when in contact with an abrasive particle 11 than when in contact with the substrate layer 7. Accordingly, since the abrasive particles form a stronger rupturing mechanism, stronger-shelled fragrance-filled capsules 13, requiring a greater rupture forces, may be used with the present invention, and/or fewer fragrance-filled capsules 13 may be used. These features may result in heavy-duty scented fingernail file and buffer configurations.

Another interesting feature associated with the unique combination of abrasive particles 11 and fragrance capsules 13, according to the presently preferred embodiment, is a relationship between the filing force exerted by the scented fingernail file and buffer 5 and the strength of the aroma emitted from the fragrance-filled capsules 13. Generally, the filing force generated by the scented fingernail file and buffer 5 may be increased with the increased pressure on the target surface, and may also be increased with increased filing speed. In the past, users have been required to approximate the filing force that should be applied to the fingernail or toenail, for example. Since differences in filing force will generate different results on the fingernail or toenail, a highly skilled or sensitive user of the present invention may be able to fine-tune the filing process, based upon the strength of the fragrance emitted from the scented fingernail file and buffer 5. For example, a user, who wishes to generate a very smooth surface on his or her fingernail, will be warned that the filing force is too great when a relatively strong fragrance is emitted from the scented fingernail file and buffer 5.

The scent emitted from the fragrance-filled capsules 13 during use of the scented fingernail file and buffer 5 can serve to mask the smell, if any, associated with fingernail or toenail dust. Additionally, when the scented fingernail file and buffer 5 is used on other objects, any smells associated with the dust generated by the filing thereof, can be masked by the aromas emitted from the fragrance-filled capsules 13.

In addition to emitting fragrances into the atmosphere, the fragrances from the fragrance-filled capsules 13 are also emitted onto the target surface. Many users would regard the application of a desirable scent on their fingernails after filing, for example, to be quite an advantageous feature. The user who is not familiar with scenting his or her fingernails may regard this phenomena in a positive way. Alternatively, users who are already accustomed to scenting their fingernails would more than likely appreciate the saved step of not having to subsequently apply a scent or fragrance to their fingernails after filing.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

What is claimed is:

1. A scented fingernail file and buffer for contacting and filing a target surface, the scented fingernail file and buffer comprising:

a base structure;

a substrate layer disposed on the base structure;

an abrasive material disposed within the substrate layer, the abrasive material comprising emery, silicon carbide, aluminum oxide, diamond and/or quartz, or other abrasive grains; and fragrance-filled capsules disposed within the substrate layer, each of the fragrance-filled capsules having properties for being ruptured by the target surface, when the scented fingernail file and buffer is frictionally placed into contact with the target surface.

2. The scented fingernail file and buffer as recited in claim 1, the scented fingernail file and buffer further comprising at least one brightly colored pigment disposed on an outer surface of the scented fingernail file and buffer.

3. The scented fingernail file and buffer as recited in claim 1, the scented fingernail file and buffer comprising a nail file, the base structure comprising a strip of plastic and/or a foam cushion, the substrate layer comprising an adhesive, and the abrasive particles and the fragrance-filled capsules being adhesively applied onto the base structure with the substrate layer.

4. The scented fingernail file and buffer as recited in claim 1, the target surface comprising a fingernail, and the abrasive particles and the fragrance-filled capsules being formed within the substrate layer.

5. The scented fingernail file and buffer as recited in claim 1, the fragrance-filled capsules comprising gelatin shells filled with fragrances.

6. The scented fingernail file and buffer as recited in claim 5, the fragrances including fruit aromas.

7. The scented fingernail file and buffer as recited in claim 1, the substrate layer being adhesively attached to the base.

8. The scented fingernail file and buffer as recited in claim 1, the substrate layer being integrally formed with the base structure.

9. The scented fingernail file and buffer as recited in claim 8, the substrate layer and the base structure comprising the same material.

10. A scented fingernail file and buffer for contacting and filing a target surface, the scented fingernail file and buffer comprising:

a base structure;

a substrate layer disposed on the base structure;

an abrasive material disposed within the substrate layer, the abrasive material comprising emery, silicon carbide, aluminum oxide, diamond and/or quartz, or other abrasive grains; and fragrance-filled capsules disposed within the substrate layer, each of the fragrance-filled capsules being adapted for being ruptured in part by at least one of the abrasive particles, when the scented fingernail file and buffer is frictionally placed into contact with the target surface.

11. The scented fingernail file and buffer as recited in claim 10, the scented fingernail file and buffer further comprising brightly colored pigments disposed on an outer surface of the scented fingernail file and buffer.

12. The scented fingernail file and buffer as recited in claim 10, the base structure comprising a strip of plastic, and the abrasive particles and the fragrance-filled capsules being attached to the strip of plastic with the substrate layer.

13. The scented fingernail file and buffer as recited in claim 12, the fragrance-filled capsules comprising gelatin shells filled with fragrances.

14. The scented fingernail file and buffer as recited in claim 13, the fragrances having fruit or plant/herbal aromas.

15. A scented fingernail file and buffer for frictionally contacting a target surface, the scented fingernail file and buffer comprising:

a substrate;

abrasive particles disposed within the substrate; and fragrance-emitting means disposed within the substrate, the fragrance-emitting means being adapted for emitting a fragrance when the abrasive particles of the fingernail file and buffer are frictionally placed into contact with a target surface.

16. The scented fingernail file and buffer as recited in claim 15, the scented fingernail file and buffer further comprising brightly colored pigments disposed on the substrate.

17. The scented fingernail file and buffer as recited in claim 16, the fragrance-emitting means comprising capsules filled with materials suitable for emitting fruit or plant/herbal aromas when placed into contact with the atmosphere.

18. The scented fingernail file and buffer as recited in claim 17, the capsules comprising gelatin shells.

19. A method of frictionally contacting a target surface with a scented fingernail file and buffer, comprising the following steps:

providing a scented fingernail file and buffer, the scented fingernail file and buffer having a plurality of abrasive particles and fragranced particles disposed therein;

placing the scented fingernail file and buffer into frictional contact with the target surface; and moving the scented fingernail file and buffer over the target surface, the movement of the scented fingernail file and buffer over the target surface causing the abrasive particles to abrade the target surface and causing the fragranced particles to emit fragrances onto the target surface and into the atmosphere.

20. The method according to claim 19, the fragranced particles comprising fragrance-filled capsules, and the step of moving the scented fingernail file and buffer over the target surface comprising a step of at least one of the abrasive particles rupturing at least one of the fragrance-filled capsules.

* * * * *